United States Patent [19]

Mitchell et al.

[11] 4,191,540

[45] * Mar. 4, 1980

[54] CARBON DIOXIDE ACCEPTOR PROCESS USING COUNTERCURRENT PLUG FLOW

[75] Inventors: David S. Mitchell; David R. Sageman, both of San Rafael, Calif.

[73] Assignee: Chevron Research Company, San Francisco, Calif.

[ * ] Notice: The portion of the term of this patent subsequent to Jun. 5, 1996, has been disclaimed.

[21] Appl. No.: 890,886

[22] Filed: Mar. 27, 1978

[51] Int. Cl.[2] ..... C10J 3/54

[52] U.S. Cl. ..... 48/197 R; 48/202; 252/373

[58] Field of Search ..... 48/197 R, 202, 206, 48/210, DIG. 4; 252/373; 201/38

[56] References Cited

U.S. PATENT DOCUMENTS

| | | | |
|---|---|---|---|
| 3,194,644 | 7/1965 | Gorin et al. | 48/197 R |
| 3,516,808 | 6/1970 | Curran et al. | 48/197 R |

FOREIGN PATENT DOCUMENTS

| | | | |
|---|---|---|---|
| 2704032 | 9/1977 | Fed. Rep. of Germany | 48/202 |

OTHER PUBLICATIONS

Synthetic Fuels Data Handbook, 1973, pp. 190–196, Cameron Engineers, Inc.

*Primary Examiner*—S. Leon Bashore
*Assistant Examiner*—Peter F. Kratz
*Attorney, Agent, or Firm*—D. A. Newell; R. H. Evans

[57] ABSTRACT

Disclosed is an improved $CO_2$ acceptor process for the gasification of carbonaceous solids to produce $H_2$, CO and $CH_4$. In the process a hot calcined $CO_2$ acceptor solid and a carbonaceous solid are contacted in countercurrent plug-like flow in a gasification vessel filled with packing or other suitable internals. The $CO_2$ acceptor flows downwardly through the vessel in a fluidized state, countercurrent to entrained carbonaceous solid flowing upwardly through said vessel. The heat of gasification is provided by sensible heat transfer from the calcined $CO_2$ acceptor solid to the carbonaceous solid and by the exothermic heat of reaction of the calcined $CO_2$ acceptor with $CO_2$ generated in the process.

10 Claims, 1 Drawing Figure

CARBON DIOXIDE ACCEPTOR PROCESS USING COUNTERCURRENT PLUG FLOW

BACKGROUND OF THE INVENTION

1. Field of the Invention

The present invention relates to the gasification of carbonaceous solids to produce a gas comprising $H_2$, CO and $CH_4$. More particularly, the invention relates to an improved $CO_2$ acceptor process wherein the $CO_2$ acceptor and the carbonaceous solids are contacted in countercurrent plug-like flow.

2. Prior Art

As a result of the dwindling supplies of petroleum and natural gas, extensive research efforts have been directed towards the conversion of coal into suitable gas or liquid fuels. In comparison to known petroleum and natural gas reserves, coal supplies are abundant and the United States is fortunate to have approximately one-third of the world's known coal reserve. Coal may be gasified by a number of processes to produce combustible gases. These gases may generally be upgraded by the familiar shift conversion to produce a high BTU content gas of pipeline quality, or used directly as an industrial source of low to medium BTU content gas or converted into liquid fuels by a Fischer-Tropsch type synthesis.

Of the many coal gasification processes under investigation for commercial purposes in the United States, the promising and unique $CO_2$ acceptor process merits serious consideration. The mineral dolomite, a calcium-magnesium carbonate, serves a unique role in the process and is the basis for the process name. If dolomite is calcined at 1800°–1900° F., $CO_2$ is released and the dolomite is transformed from a carbonate to an oxide state. In the oxide state the dolomite will chemically combine with gaseous $CO_2$ and thus afford means for the removal of same from a process stream. The "acceptance" of $CO_2$ by the oxide form dolomite is exothermic and the heat of reaction may be used to advantage in the process.

In the basic $CO_2$ acceptor process, steam is reacted with crushed lignite in a fluidized bed gasifier at a temperature of approximately 1500° F. to produce $CH_4$, CO, $CO_2$, and $H_2$. Hydrocarbons, including tars, above ethane or propane are cracked under the severe gasification conditions to produce $CH_4$ and coke, and, thus, do not appear in the product. Heat for the endothermic gasification process is provided by showering calcined dolomite at a temperature of approximately 1850° F. through the fluidized bed of lignite. Sensible heat transfer occurs in the fluidized bed as the dolomite cools from 1850° F. to 1500° F. and additional heat is generated by the exothermic reaction of the oxide form dolomite with $CO_2$ to produce the carbonate form dolomite. The spent acceptor, or carbonate form dolomite, is withdrawn from the gasifier and calcined in a separate vessel to produce the oxide form dolomite for recycle to the gasifier. Thus, the dolomite serves the two important functions of providing heat for the gasification reactions and removing $CO_2$ from the product gas.

While attractive from a theoretical standpoint, the existing $CO_2$ acceptor gasifiers are limited by solids and gas throughout. The gasification is carried out in a fluidized bed of lignite with steam and recycle synthesis gas passing upwardly through the bed as a fluidization medium. The fluidization gas velocity is, therefore, restricted to a range between the minimum fluidization velocity and the terminal velocity of the lignite particles in the bed, and a value of about 1 foot per second appears to be typical. For a fixed gas composition, the amount of carbon gasified (lb/hr/ft$^2$) is dependent only upon the gas velocity. In the article "$CO_2$ Acceptor Process" appearing in the proceedings of the Sixth Pipeline Gas Symposium, Chicago, 1974, by C. Fink et al, the published information indicates a typical carbon gasification rate of approximately 140 lb/hr/ft$^2$. This low gasification rate dictates that the reactor will have a low length to diameter ratio, tending to make it very expensive on a commercial scale.

It is therefore an object of this invention to provide a unique gasification process for a $CO_2$ acceptor system which will result in a much greater throughput capacity and a corollary reduced gasifier capital expense, while retaining the salient advantages of the basic process.

SUMMARY OF THE INVENTION

The present invention relates to an improved $CO_2$ acceptor gasification process for gasifying a solid carbonaceous material in a gasification zone, which comprises:

introducing into an upper portion of the gasification zone particulate $CO_2$ acceptor solids at an elevated temperature;

passing said particulate $CO_2$ acceptor solids downwardly through the gasification zone;

introducing into a lower portion of the gasification zone particulate carbonaceous solids, the physical characteristics of the $CO_2$ acceptor solids and the carbonaceous solids differing such that a gas flowing upwardly through the gasification zone at a velocity greater than than necessary to fluidize the $CO_2$ acceptor solids and at a velocity less than that necessary to entrain said $CO_2$ acceptor solids will entrain the carbonaceous solids;

passing a fluidization gas containing steam upwardly through the gasification zone at a rate sufficient to fluidize the $CO_2$ acceptor solids and entrain the carbonaceous solids, whereby at least a portion of said steam reacts with at least a portion of said carbonaceous solids to form a gaseous product containing $CO_2$, which $CO_2$ substantially reacts with the $CO_2$ acceptor solids to form spent acceptor solids;

maintaining substantially plug flow of the solids and gases through said gasification zone by limiting gross vertical back-mixing of the solids and gases;

withdrawing $CO_2$ acceptor solids and spent acceptor solids from a lower portion of said gasification zone; and removing from an upper portion of said gasification zone the remaining fluidization gas, the remaining gaseous product and the remaining entrained carbonaceous solids.

The $CO_2$ acceptor solids may include dolomite, alkaline earth oxides or synthetic acceptors prepared by the deposition of calcium oxide on alpha-alumina or magnesia and the carbonaceous solids may include coal, char or peat. A preferred fluidization gas comprises steam mixed with recycle synthesis, or product, gas. The flow rate of said gas may advantageously be maintained between 1 foot/second and 20 feet/second in the gasification zone. Limiting of the gross vertical backmixing of the solids and gases in the gasifier may be attached by disposing barriers in the interior of said gasifier, which barriers may comprise packing, perforated plates, bars, screens, or other fixed internals.

The invention may further include: passing at least a portion of the effluent solids withdrawn from the lower portion of said gasification zone to an upper portion of a combustion zone separate from said gasification zone and downwardly therethrough;

introducing particulate combustible carbonaceous solids into a lower portion of said combustion zone, the physical characteristics of said effluent solids and said combustible carbonaceous solids differing such that a gas flowing upwardly through the combustion zone at a velocity greater than that necessary to fluidize the effluent solids and at a velocity less than that necessary to entrain said effluent solids will entrain the combustible carbonaceous solids;

passing a fluidization gas containing oxygen upwardly through said combustion zone at a rate sufficient to fluidize the effluent solids and entrain the combustible carbonaceous solids, whereby at least a portion of said combustible carbonaceous solids are combusted to sufficiently heat said effluent solids to regenerating temperature thereby converting at least a portion of the spent acceptor solids in said effluent solids to $CO_2$ acceptor solids;

maintaining substantially plug flow of the solids and gases throughout said combustion zone by limiting gross vertical backmixing of said solids and gases;

withdrawing $CO_2$ acceptor solids and any remaining spent acceptor solids from a lower portion of said combustion zone and recycling at least a portion of said solids to the upper portion of said gasification zone; and removing from an upper portion of the combustion zone the remaining fluidization gas and the remaining entrained combustible carbonaceous solids.

Preferably the combustible carbonaceous solids include at least a portion of the entrained carbonaceous solids recovered overhead from the gasification zone.

BRIEF DESCRIPTION OF THE DRAWING

The drawing illustrates a schematic flow diagram of suitable apparatus and flow paths for use in accordance with one embodiment of the invention.

DETAILED DESCRIPTION OF THE PREFERRED EMBODIMENTS

Figure 1:
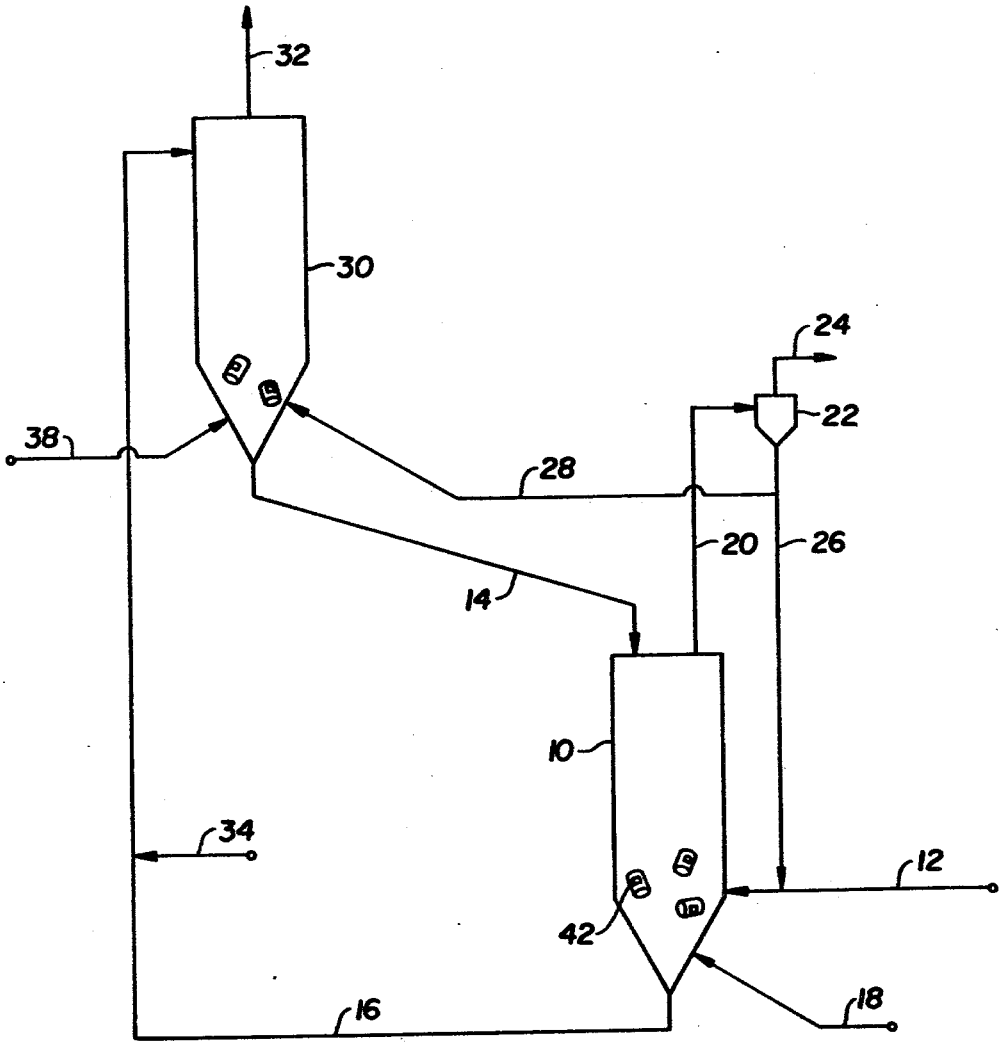

While the process of the present invention is described hereinafter with particular reference to the gasification of lignite, it will be apparent that the process can also be used to retort other coals, char, peat and similar carbonaceous solids.

The drawing is a schematic flow diagram of suitable apparatus and flowpaths for gasifying lignite in accordance with the present invention. As shown therein, lignite is introduced into the lower portion of a gasifier 10 through line 12. The lignite is entrained and carried upwardly through gasifier 10 by a fluidization gas, containing steam, which is introduced in a lower portion of said gasifier via line 18. Regenerated dolomite, introduced at an upper portion of the gasifier through line 14, passes downwardly therethrough in a fluidized state, accepting $CO_2$ produced by the gasification reactions. The nonreacted lignite char, product gas and fluidization gas pass overhead from the gasifier through line 20 to separation zone 22. In zone 22 the char is separated from the gases and a portion thereof is recycled to the gasifier via line 26. A second portion of said char is passed through line 28 to a lower portion of a regenerator 30.

Spent dolomite is withdrawn from a lower portion of gasifier 10 and passes through line 16 to an upper portion of regenerator 30. If necessary, makeup dolomite may be added to the system through line 34 to line 16. Air is introduced to a lower portion of regenerator 30 through line 38 and entrains the char passing into said regenerator. The char is burned in the presence of the air and heats the spent dolomite to regenerating temperatures as same passes downwardly through the regenerator 30 in a fluidized state. The regenerated dolomite is withdrawn from a lower portion of regenerator 30 and recycled to the gasifier through line 14. The hot flue gas passing from regenerator 30 through line 32 may be used for steam generation or process preheat. The product gas may be recovered by conventional means from line 24 and a portion of said gas recycled with added steam to the gasifier 10.

The most significant advantage of the present invention lies in the greatly increased carbon gasification rate per unit cross-sectional area of reactor. Gasification in the $CO_2$ acceptor process primarily depends upon the reaction of steam with the carbonaceous solids. Thus the steam throughput is a limiting factor in the over-all process. In most $CO_2$ acceptor processes, the steam is also mixed with recycle synthesis gas for control of the steam partial pressure in the gasifier to prevent undesirable melt formations and since the combined steam and recycle synthesis gas serves as the fluidizing medium for the carbonaceous solids, the upper gas velocity through the gasifier must be kept below the terminal velocity of the carbonaceous solids fed to the unit. Thus, the gasifier rate is quite limited per cross-sectional area of the reactor for a given gas composition and pressure. Increasing the process pressure of the gasifier will, of course, increase the gasification rate but at the expense of increased vessel costs. Therefore, increasing the gas velocity while retaining the advantages of a fluidized bed reactor is the only practical solution to the problem.

The process of the present invention overcomes the deficiencies of the existing $CO_2$ acceptor systems by maintaining a countercurrent plug-like flow of two solids in a gasification vessel. The upwardly flowing solid is the carbonaceous solid entrained in an upwardly flowing reactive fluidization gas and the downwardly flowing solid is a fluidized $CO_2$ acceptor. As the $CO_2$ acceptor has a higher terminal velocity than the carbonaceous solid, increased gas velocities are achieved resulting in a correspondingly increased gasification rate per cross-sectional area of reactor.

The present invention will now be described in more detail with reference to the drawing.

Lignite, or other suitable subdivided carbonaceous solid, is introduced into a lower portion of a gasifier, generally characterized by reference numeral 10, by conventional means, through line 12. The term "carbonaceous solids" as used herein includes coal, char, peat and mixtures thereof. Preferred coals for the process comprise lignite and the sub-bituminous coals since higher rank coals react more slowly at the preferred process temperatures. Carbonaceous solids may be introduced to the gasifier which contain substantial amounts of moisture. In fact, approximately 50–70% of the steam required for reaction will normally be supplied by the moisture present in the carbonaceous solids. This feature is particularly attractive for gasification units wherein the coal is supplied by coal-water slurry pipelines as drying of the coal prior to use will be unnecessary. The size of the solids fed to the gasifier must be considered with regard to other process variables and is discussed later.

Subdivided $CO_2$ acceptor solids are introduced into an upper portion of the gasifier by conventional means through line 14. As used herein, the term "$CO_2$ acceptor solid" refers to an acceptor material which has been regenerated to the oxide form and is thus in a suitable state for combination with carbon dioxide, whereas the term "spent acceptor" refers to a $CO_2$ acceptor solid which has already reacted with $CO_2$. Numerous acceptors are known in the art such as the alkaline earth oxides, i.e., an oxide of calcium, magnesium, barium or strontium, and various synthetic acceptors have been produced which are suitable for use. The preferred acceptors, however, are natural dolomites and synthetic acceptors prepared by deposition of calcium oxide on alpha-alumina or magnesia. The $CO_2$ acceptor solids may be introduced to the upper portion of the gasifier at temperatures ranging from approximately 1600° F. to 1900° F. with a preferred temperature of approximately 1850° F. Spent acceptor and any unreacted $CO_2$ acceptor solids are removed from a lower portion of the gasifier by conventional means through line 16 to maintain a net downward flow of $CO_2$ acceptor solids and spent acceptor through the gasifier. The exit temperature of the effluent solids will, of course, vary depending upon the process flow rates but will normally be in the range of 1400° F. to 1550° F., and preferably at a temperature of approximately 1520° F.

A reactive fluidization gas is introduced into a lower portion of gasifier 10, via line 18, and passes upwardly through the gasifier at a rate sufficient to entrain the carbonaceous solids and fluidize the downwardly moving $CO_2$ acceptor solids and spent acceptor, hereinafter referred to as "acceptor solids". Thus, it is seen that the choice of appropriately classified carbonaceous solids and $CO_2$ acceptor solids is an important feature of the present invention. The physical characteristics of the downflowing acceptor solids must differ from the upflowing carbonaceous solids such that the acceptor solids are not entrained by the upflowing gases while at the same time the carbonaceous solids must be entrained through the vessel by the fluidization gas. The physical characteristics of the downflowing acceptor solids must, in general, differ from the physical characteristics of the upflowing carbonaceous solids such that the superficial velocity of the gas flowing through the vessel is greater than the minimum fluidization velocity of the downflowing acceptor solids and less than the terminal velocity of the downflowing acceptor solids, while at the same time the superficial velocity of the upflowing gas must be greater than the terminal velocity of the carbonaceous solids. In general, the most important physical characteristics of the solids are size, shape and density.

If one considers only size, shape and density, then the downflowing acceptor solids must, in general, differ in size, shape or density from the upflowing carbonaceous solids such that the net force exerted on the downflowing solids is greater than the net force exerted on the upflowing solids. "Net force" is defined to mean the sum of the gravitational force exerted on the solids, plus the drag force exerted on the solids by the upflowing fluidization gases, plus the buoyancy force exerted on the solids by the fluidization gas. Preferably the physical characteristics of the two solids are substantially different such that the velocity of the upflowing gases can be varied over a wide range with the downflowing solids being maintained in a fluidized state while the upflowing solid is entrained.

As previously discussed, the fluidization and entrainment characteristics of solids will depend on many factors; however, carbonaceous solids having a particle size smaller than 20 mesh, and preferably smaller than 60 mesh, will generally be suitable with dolomite acceptor solids in the size range 45 mesh to ¼ inch, preferably 45 mesh to 8 mesh.

The fluidization gas introduced to the gasifier may comprise steam but preferably comprises steam and recycle synthesis gas produced in the process. Steam in the fluidization gas and steam produced from moisture in the carbonaceous solids reacts with carbon to produce CO, $CO_2$ and $CH_4$. Heavier hydrocarbons may also be formed, but are cracked under the gasification conditions. A substantial amount and preferably all of the $CO_2$ produced reacts with the $CO_2$ acceptor solids to form spent acceptor. The latter reaction is exothermic and can provide approximately 75% of the heat required for the gasification reaction. Remaining heat requirements are supplied by the cooling of the acceptor solids as they pass through the gasifier. Typical fluidization gas velocities will be in the range of 1 foot/-second to 20 feet/second and preferably in the range of 3 feet/second to 7 feet/second, thus providing approximately a five-fold increase in the gasification rate.

Product gas, comprised of $H_2$, CO and methane and a small amount of $CO_2$ along with entrained char, passes from an upper portion of the gasifier, via line 20, to a separation unit 22, typically comprised of a cyclone separator or other suitable and well-known means for separation of gas and solids, wherein the product gas and char are separated into lines 24 and 26, respectively. A portion of the char may be recycled to gasifier 10 via lines 26 and 12. The ratio of recycled char to fresh carbonaceous solids can vary widely, depending upon many interrelated factors, but generally will be in the range of 5:1 to 50:1 and preferably in the range 5:1 to 20:1. A second portion of the separated solids is fed to regenerator 30, which operates as a separate combustion zone, via line 28 wherein the spent acceptor solids are regenerated.

In regenerator 30, the spent acceptor may be regenerated by conventional means, but preferably is regenerated in a countercurrent solids contactor similar to the gasifier described herein. The spent acceptor particles are removed from gasifier 10 via line 16 by conventional means at temperatures in the range 600° F. to 1500° F. and preferably 800° F. to 1200° F., and are introduced into an upper portion of the regenerator 30 and flow downwardly through the vessel countercurrent to upflowing carbonaceous solids, preferably entrained char from the gasifier. Air, introduced to a lower portion of regenerator 30, via line 38, is used as the fluidization gas and the high temperatures of combustion attained in the regenerator vessel regenerates the spent acceptor solids to $CO_2$ acceptor solids and also raises the $CO_2$ acceptor solids to a temperature in the range 1500° F. to 2100° F. Hot flue gas, acceptor fines, and solids ash are removed from the top of the regenerator via line 32 for disposal and/or waste heat generation. $CO_2$ acceptor solids are removed from the lower portion of regenerator 30 and recycled via line 14 to the top of the gasifier. Any make-up acceptor required as a result of attrition or loss of activity may be added to the process, preferably through line 34 to line 16.

The gasifier is basically comprised of an elongated vertical shell 40 substantially filled with packing 42, or other means, such as fixed internals, for substantially impeding vertical backmixing of both the upflowing solid and the downflowing solid. The means for impeding backmixing must substantially impede backmixing throughout substantially the whole solids contacting zone. The object of including means for impeding backmixing in the contacting zone is to maintain essentially plug flow of both the upwardly moving carbonaceous solids and downwardly moving acceptor solids. Suitable means for impeding backmixing, i.e., means for providing essentially countercurrent plug flow of the solids, include packing materials, i.e., fixed beds of subdivided materials not attached to the sheel defining the contact zone. Suitable means for impeding backmixing to provide essentially plug flow of the solids also include internal apparatus fixed to the shell of the vessel, i.e., perforated plates, horizontal bars, screens, etc.

Maintaining continuous countercurrent plug flow substantially throughout the contacting zone has many advantages, including:

(1) Plug flow, wherein there is little or no gross backmixing of either solid in the treatment zone, provides much higher conversion levels of carbonaceous material in a smaller contacting zone volume than can be obtained in fluidized-bed reactors with gross top-to-bottom mixing, even when the fluidized-bed reactors are divided into 2 to 5 distinct fluidized bed zones. In conventional unpacked fluidized beds or in stirred-tank reactors, the product stream removed from the conventional contacting zone approximates the average conditions in the contacting zone. Thus, in such processes, unreacted or partially reacted material is necessarily removed with the product stream, leading to costly separation and recycle of unreacted materials. Maintaining plug flow and preventing top-to-bottom mixing of either solid, on the other hand, allows one to operate the process of the present invention on a continuous basis with the residence time being precisely controlled to attain the desired degree of reaction.

(2) The effect of countercurrent plug flow of two solids also has a significant advantage with regard to controlling and optimizing the heat-transfer and reaction temperatures in the treatment zone. For example, with the hot acceptor material entering the top of the contacting or treatment zone and the relatively cold carbonaceous material entering the bottom of the treatment zone or chamber, a desirable thermal gradient is obtainable with the maximum and minimum temperatures at opposite ends of the contacting zone.

(3) Plug flow, without top-to-bottom solids backmixing, also permits a substantial reduction in the size of the reaction zone required, since the need for a large disengaging zone (as is normally required in unpacked fluidized beds) is eliminated. In many systems with fluid beds in which backmixing is not prevented, a large portion of the volume of the vessel, frequently from 50% to 80%, is used as a disengaging zone. Bubbles formed in the fluid bed burst at the top of the bed, spouting upwardly a large amount of material. A large disengaging zone is necessary in such conventional systems to allow this material to drop back into the fluid portion of the bed and avoid carry-over of the solids out of the vessel along with the fluidizing gas. Since coalescence of large bubbles is prevented in the present invention, this slugging and bursting is essentially eliminated, allowing the size of the disengaging zone to be substantially reduced.

While gross backmixing must be avoided, highly localized mixing is desirable in that it increases the degree of contacting between the solids and gases. The degree of backmixing is, of course, dependent on many factors, particularly the bed depth and the means employed for impeding backmixing. When packing material is used, localized backmixing will be substantially confined to within 2 to 4 layers of packing material. In order to impede backmixing throughout substantially the whole contacting zone, packing material is used in an amount sufficient to fill or substantially fill the contacting zone, except for any disengaging space at the top or bottom of a vessel defining the contacting zone.

Packing materials are the preferred means for impeding backmixing in carrying out the process of the invention. Numerous packing materials known to those skilled in the art include spheres, cylinders and other specially shaped items, etc. Any of these numerous packing materials may produce the desired effect in causing the gross vertical flow of solids to be substantially plug-like in nature while causing highly localized mixing. A particularly preferred packing material which is well known to those skilled in the art is pall rings.

The means employed for impeding backmixing may also include "fixed" typed internals. Examples of suitable internals which are typically fixed to the wall of a vessel, shell, reactor, or the like, wholly or partly defining the contacting zone are horizontal tubes and/or rods, vertical tubes and/or rods, combinations of horizontal tubes and/or rods and vertical tubes and/or rods, slats, screens and grids, perforated plates, corrugated baffles, combinations of horizontal grids and wire spacers, combinations of two or more of the above-listed apparatus, and like internals used by those skilled in the art, conventionally fixed to the wall of vessels for impeding flow therein. Thus, although packing materials such as pall rings are particularly preferred means for impeding backmixing in the contacting zone, the above-described internals typically fixed to the wall of a vessel can also be used, either as a substitute for the packing or in combination with the packing material. In order to impede backmixing substantially throughout the contacting zone, internals fixed to the wall of a vessel defining the contacting zone must be positioned substantially throughout the contacting zone. That is, the internals are used to provide the same effect as would be obtained by substantially filling the contacting zone with a packing material, such as pall rings.

What is claimed is:

1. A $CO_2$ acceptor gasification process for gasifying a solid carbonaceous material in a gasification zone, which comprises:

introducing into an upper portion of the gasification zone particulate $CO_2$ acceptor solids at an elevated temperature;

passing said particulate $CO_2$ acceptor solids downwardly through the gasification zone;

introducing into a lower portion of the gasification zone particulate carbonaceous solids, the physical characteristics of the $CO_2$ acceptor solids and the carbonaceous solids differing such that a gas flowing upwardly through the gasification zone at a velocity greater than that necessary to fluidize the $CO_2$ acceptor solids and at a velocity less than that necessary to entrain said $CO_2$ acceptor solids will entrain the carbonaceous solids;

passing a fluidization gas containing steam upwardly through the gasification zone at a rate sufficient to fluidize the $CO_2$ acceptor solids and entrain the carbonaceous solids, whereby at least a portion of said steam reacts with at least a portion of said carbonaceous solids to form a gaseous product containing $CO_2$, which $CO_2$ substantially reacts with the $CO_2$ acceptor solids to form spent acceptor solids;

maintaining substantially plug flow of the solids and gases throughout said gasification zone by limiting gross vertical backmixing of said solids and gases;

withdrawing effluent solids, including $CO_2$ acceptor solids and spent acceptor solids from a lower portion of said gasification zone; and removing from an upper portion of said gasification zone the remaining fluidization gas, the remaining gaseous product and the remaining entrained carbonaceous solids.

2. A $CO_2$ acceptor gasification process as recited in claim 1, wherein said $CO_2$ acceptor solids are selected from the group consisting of dolomite, alkaline earth oxides, and synthetic acceptors prepared by deposition of calcium oxide on alpha-alumina or magnesia.

3. A $CO_2$ acceptor process as recited in claim 1, wherein said carbonaceous material is selected from the group consisting of coal, char, and peat.

4. A $CO_2$ acceptor process as recited in claim 1, wherein the flow rate of said fluidization gas is such that the gas velocity in the gasification zone is between 1 foot/second and 20 feet/second.

5. A $CO_2$ acceptor process as recited in claim 1, wherein the fluidization gas includes gas removed from the upper portion of said gasification zone and recycled thereto.

6. A $CO_2$ acceptor process as recited in claim 1, wherein said carbonaceous solids are introduced into the lower portion of the gasification zone in a water slurry.

7. A $CO_2$ acceptor process as recited in claim 1, further comprising:

passing at least a portion of the effluent solids withdrawn from the lower portion of said gasification zone to an upper portion of a combustion zone separate from said gasification zone and downwardly through said combustion zone;

introducing particulate combustible carbonaceous solids into a lower portion of said combustion zone, the physical characteristics of said effluent solids and said combustible carbonaceous solids differing such that a gas flowing upwardly through the combustion zone at a velocity greater than that necessary to fluidize the effluent solids and at a velocity less than that necessary to entrain said effluent solids will entrain the combustible carbonaceous solids;

passing a fluidization gas containing oxygen upwardly through said combustion zone at a rate sufficient to fluidize the effluent solids and entrain the combustible carbonaceous solids, whereby at least a portion of said combustible carbonaceous solids are combusted to sufficiently heat said effluent solids to regenerating temperature thereby converting at least a portion of the spent acceptor solids in said effluent solids to $CO_2$ acceptor solids;

maintaining substantially plug flow of the solids and gases throughout said combustion zone by limiting gross vertical backmixing of said solids and gases;

withdrawing $CO_2$ acceptor solids and any remaining spent acceptor solids from a lower portion of said combustion zone and recycling at least a portion of said solids to the upper portion of said gasification zone; and removing from an upper portion of the combustion zone the remaining fluidization gas and the remaining entrained combustible carbonaceous solids.

8. A $CO_2$ acceptor gasification process as recited in claim 1, wherein said limiting of the gross vertical backmixing of said solids and gases is attained by passing said solids and gases through barriers disposed in said gasification zone.

9. A $CO_2$ acceptor gasification process as recited in claim 8, wherein said barriers are selected from the group consisting of packing, or fixed internals.

10. A $CO_2$ acceptor process, as recited in claim 9 wherein at least a portion of the combustible carbonaceous solids includes at least a portion of the remaining entrained carbonaceous solids removed from the upper portion of the gasification zone.

* * * * *